US010040521B2

(12) United States Patent
Fournier

(10) Patent No.: US 10,040,521 B2
(45) Date of Patent: Aug. 7, 2018

(54) SHIP STABILIZER SYSTEM

(71) Applicant: Elisabeth Fournier, Hyeres (FR)

(72) Inventor: Elisabeth Fournier, Hyeres (FR)

(73) Assignee: Elisabeth Fournier, Hyeres (FR)

( * ) Notice: Subject to any disclaimer, the term of this patent is extended or adjusted under 35 U.S.C. 154(b) by 0 days.

(21) Appl. No.: 15/551,505

(22) PCT Filed: Feb. 17, 2016

(86) PCT No.: PCT/EP2016/053312

§ 371 (c)(1),
(2) Date: Aug. 16, 2017

(87) PCT Pub. No.: WO2016/131850

PCT Pub. Date: Aug. 25, 2016

(65) Prior Publication Data

US 2018/0057125 A1 Mar. 1, 2018

(30) Foreign Application Priority Data

Feb. 17, 2015 (FR) ..... 15 51334

(51) Int. Cl.
*B63B 39/06* (2006.01)

(52) U.S. Cl.
CPC ..... *B63B 39/06* (2013.01); *B63B 2039/065* (2013.01)

(58) Field of Classification Search
CPC ..... B63B 39/06; B63B 3/44; B63B 20/34; B63B 39/061; B63B 39/062; B63B 2039/063; B63B 2039/065
(Continued)

(56) References Cited

U.S. PATENT DOCUMENTS 3,463,108 A * 8/1969 Neumeier ..... B60F 3/00 114/313
4,817,550 A * 4/1989 Gutsche ..... B62D 37/04 114/124

(Continued)

FOREIGN PATENT DOCUMENTS

CN 203612181 5/2014
CN 203832725 9/2014

(Continued)

OTHER PUBLICATIONS

International Search Report for corresponding International PCT Application No. PCT/EP2016/053312, dated May 27, 2016, pp. 1-3.

*Primary Examiner* — S. Joseph Morano
*Assistant Examiner* — Jovon Hayes
(74) *Attorney, Agent, or Firm* — Hauptman Ham, LLP

(57) ABSTRACT

A system for stabilizing a vessel, comprising one or more ailerons and a drive device. The aileron is able to move about two axes, one on the longitudinal axis of the aileron substantially perpendicular to the hull at cruising speed and oscillating horizontally at zero speed of the vessel, the other fixed in direction and substantially perpendicular to the first axis and allowing its horizontal oscillation movement. The drive devices give the aileron an inclination movement at cruising speed and a scull movement on the two axes at rest. An electronic computer determines the value of the inclination, whether the vessel be sailing or at rest, and a complementary computer, when the vessel is stopped, generates an alternating movement on the substantially vertical axis and reverses the sign of the inclination calculated by the first computer according to the direction of this movement.

17 Claims, 2 Drawing Sheets

(58) Field of Classification Search
USPC ..... 114/122
See application file for complete search history.

(56) References Cited

U.S. PATENT DOCUMENTS

| | | | | |
|---|---|---|---|---|
| 5,179,906 | A * | 1/1993 | Kattwinkel | B63B 29/12 114/121 |
| 6,089,178 | A * | 7/2000 | Yamamoto | B63H 1/36 114/337 |
| 6,561,856 | B1 * | 5/2003 | Gorshkov | B63H 19/02 440/13 |
| 6,835,108 | B1 * | 12/2004 | Gieseke | B63H 1/36 440/14 |
| 6,974,356 | B2 * | 12/2005 | Hobson | B60F 3/0007 244/22 |
| 7,216,600 | B1 * | 5/2007 | Hamilton | B63B 35/81 114/242 |
| 7,300,323 | B1 * | 11/2007 | Bandyopadhyay | B63H 1/36 440/13 |
| 7,451,715 | B2 * | 11/2008 | Koop | B63B 39/06 114/126 |
| 9,527,557 | B2 * | 12/2016 | Koop | B63B 39/06 |
| 2005/0145151 | A1 * | 7/2005 | Koop | B63B 39/06 114/126 |
| 2014/0261134 | A1 * | 9/2014 | Van Aken | B63B 39/06 114/282 |
| 2018/0057125 | A1 * | 3/2018 | Fournier | B63B 39/06 |

FOREIGN PATENT DOCUMENTS

| | | |
|---|---|---|
| DE | 102011122331 | 7/2013 |
| EP | 0 129 810 | 6/1984 |
| EP | 0 754 618 | 1/1997 |
| EP | 0 903 288 | 3/1999 |
| EP | 1 498 348 | 1/2005 |
| EP | 2 172 394 | 4/2010 |
| EP | 2 452 870 | 5/2012 |
| EP | 2 565 116 | 3/2013 |
| EP | 2 669 177 | 4/2013 |
| FR | 1580846 | 1/1968 |
| GB | 802105 | 10/1958 |
| GB | 825134 | 12/1959 |
| JP | S5631893 | 3/1981 |
| JP | S6194890 | 5/1986 |
| JP | S6194891 | 5/1986 |
| JP | S6194892 | 5/1986 |
| WO | 2010/122526 | 10/2010 |
| WO | 2013/095097 | 6/2013 |
| WO | 2014-174390 | 10/2014 |

* cited by examiner

SHIP STABILIZER SYSTEM

FIELD OF THE INVENTION

The present invention relates in particular to a vessel stabilisation system and more specifically to a system for combatting roll for vessels that can function when running, when stopped and at low speed.

This invention relates to all vessels, including and particularly pleasure boats.

TECHNOLOGICAL BACKGROUND

In this field, several builders are known who produce roll stabilisers for large and small vessels.

The most widespread stabilisation technique uses ailerons. Each side of the hull of the vessel is equipped with an aileron that is adjustable for inclination about an axis extending along its length, that is to say transversely to the hull of the vessel. With the speed of the vessel, the ailerons produce hydrodynamic thrusts, thrusts of adjustable amplitude depending on the inclination of the ailerons for compensating for the torque exerted by the sea, the inclination of the ailerons being controlled by an electronic computer that is in general actuated by a gyrometer.

Normally such stabilisers are inoperative at rest and not very effective at low speed.

Some builders, in particular for pleasure applications, have proposed moving the ailerons, even at rest, so that they produce a beating in the water, always about an axis with the same direction but moved towards the leading edge of the aileron so that they keep a certain degree of efficacy at low speed, or even when the vessel is stopped. These devices (referred to as 0 speed) are not very effective.

In a conventional stabiliser, in order to limit the torque necessary for controlling the inclination of the ailerons, the stabilisation systems position the rotation axis as close as possible to the hydrodynamic thrust centre on the aileron, which creates the stabilisation lift. The manufacturers of 0 speed devices abandon this configuration at the cost of an increase in power and position the rotation axis close to the leading edge of the aileron in order to keep a certain efficacy at rest. They thus increase the amplitude of the movements of the aileron to the maximum.

These stabilisation systems are not satisfactory at rest since a major part of the energy being used to create "vortices", the movement being perpendicular to the surface of the aileron.

In addition, the movement being limited, efficacy is very low.

The system that is described in the present invention eliminates these drawbacks by using a stabiliser with a dual rotation axis "in the manner of a scull system". The first rotation axis inclines the aileron in order to create the lift in the required direction and the second rotation axis, which is in general perpendicular to the first and directed upwards, creates an alternating movement that restores horizontal speed to the aileron, with respect to the water, which the vessel no longer has at low speed or at rest.

SUMMARY OF THE INVENTION

One aspect of the invention relates in particular to a vessel stabilisation system comprising ailerons and a device for driving the ailerons.

The driving device is configured so as to produce at the same time an inclination movement with respect to the longitudinal axis of the boat and an alternation movement of each aileron on a pivot axis substantially perpendicular to the previous one and directed upwards.

This alternating movement, with a semi-vertical axis, may have great amplitude and makes it possible to obtain lift and stabilisation comparable to that of a vessel travelling.

The drive device is configured so as to coordinate the alternating pivoting movement and the inclination movement by means of a dual electronic device.

The first movement is conventional and transforms the information from the gyrometer into aileron inclination, advantageously the first movement having an amplitude strictly less than 360°, and the second movement is added to the first when the speed decreases so as, in an alternative form, to recreate the horizontal speed that would be lacking for good stabilisation.

This rotation movement in a semi-horizontal plane will be used also to fold the aileron into a housing created in the hull in the case of retractable stabilisers.

Thus one aspect of the invention concerns in particular a vessel stabilisation system, comprising an aileron able to move in a first rotation movement on an inclination axis oriented in a longitudinal dimension of the aileron, and in a second movement on a pivot axis, characterised in that the pivot axis is transverse to the inclination axis and situated in a vertical plane containing the inclination axis, the second movement being oscillatory so as to allow a movement of the aileron alternately towards the front and towards the rear of the vessel.

The invention also comprises a vessel equipped with at least one system according to the invention.

Finally, the invention also comprises a method for stabilising a vessel, comprising driving of an aileron in a first rotation movement on an inclination axis extending in a longitudinal dimension of the aileron, and in a second movement on a pivot axis, characterised in that the pivot axis is placed transversely to the inclination axis and situated in a vertical plane containing the inclination axis and in which the second movement is produced in an oscillatory fashion so as to move the aileron alternately towards the front and towards the rear of the vessel in order advantageously to create a scull movement.

BRIEF INTRODUCTION OF THE FIGURES

Other features, aims and advantages of the present invention will emerge from a reading of the following detailed description and with regard to the accompanying drawings given by way of non-limitative examples and in which.

DETAILED DESCRIPTION

Figure 1:
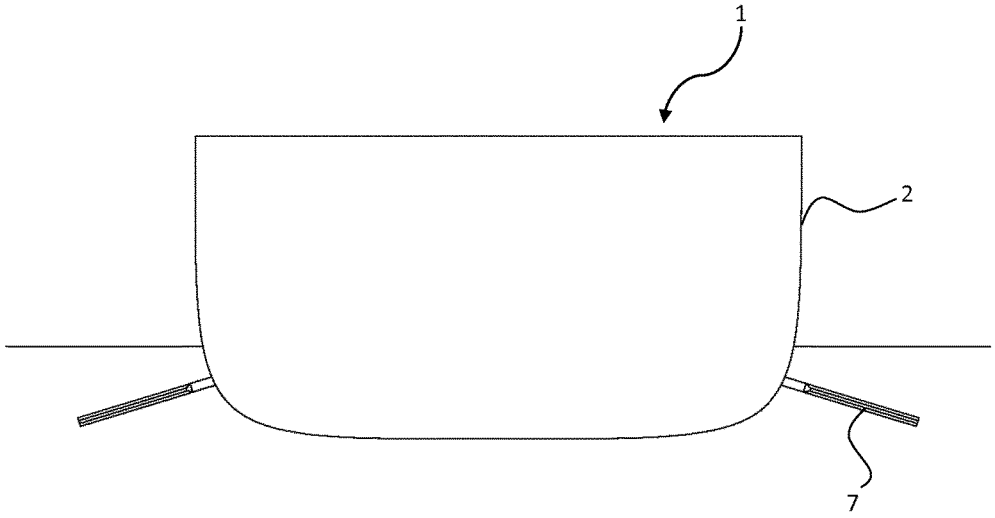
FIG. 1 shows a front view of a vessel equipped with two roll stabilisation systems in the active position.
Figure 2:
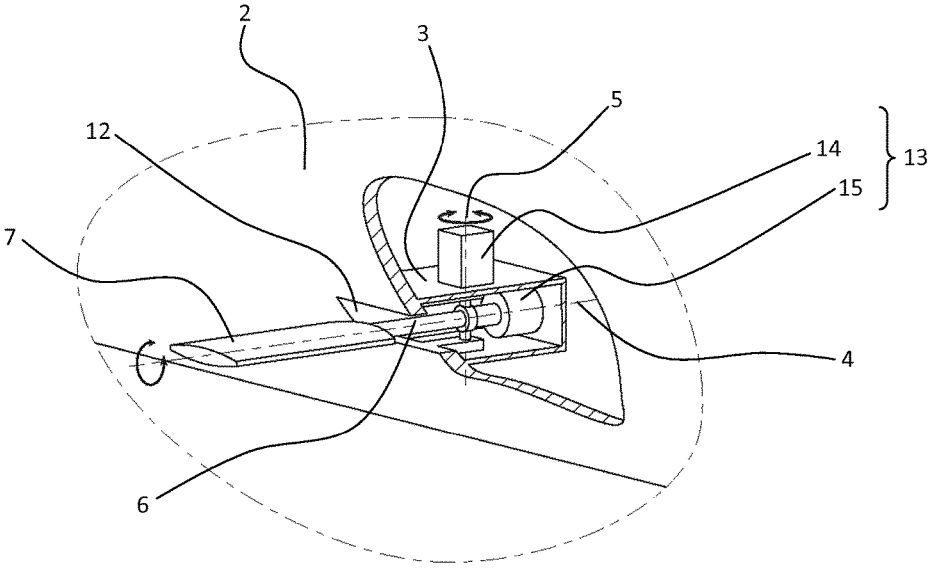
FIG. 2 is an external view of a stabilisation system in the active position with a cutout of the hull in order to view the inside.
Figure 3:
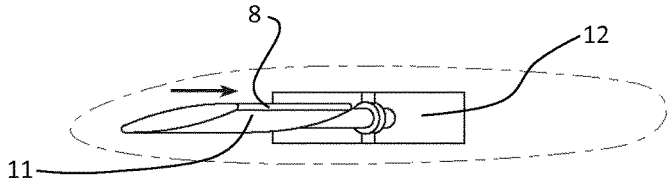
FIGS. 3 to 6 show, by means of a front view of the stabilisation system, use cycles of said stabilisation system.
Figure 4:
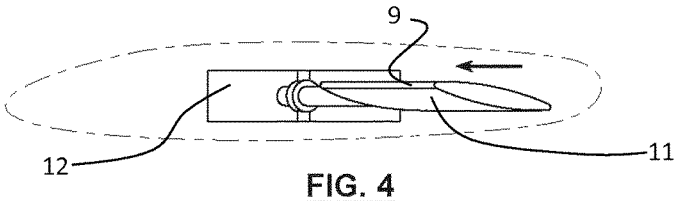
Figure 5:
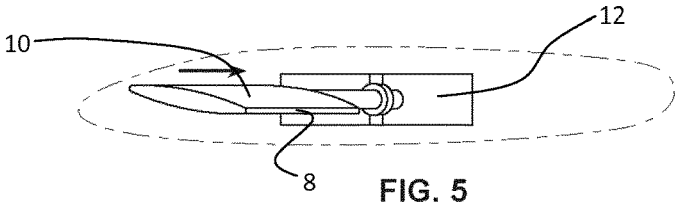
Figure 6:
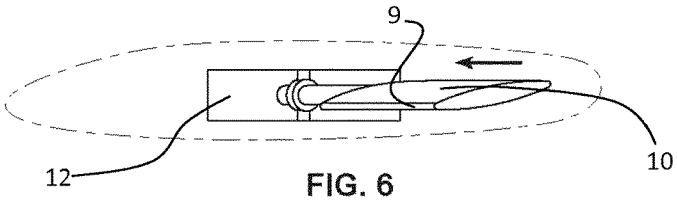

Before going into details of preferred embodiments of the invention with reference to the drawings in particular, other optional features of the invention, which may be implemented in a combined fashion according to all combinations or alternately, are indicated below:

- the first movement has an amplitude of strictly less than 360°,
- the second movement is oscillatory so as to allow a movement of the aileron 7 alternately towards the front and towards the rear of the vessel 1 so that the aileron advantageously performs a scull movement;
- a drive device 13 is configured so as to control the inclination of the aileron 7 during the second movement;
- the drive device 13 comprises a first rotating actuator 14 configured so as to produce the first movement of the aileron 7 and a second rotating actuator 15 configured so as to produce the second movement of the aileron 7, and a control element configured so as to control in combined fashion the first actuator 14 and the second actuator 15;
- the pivot axis 5 is perpendicular to the inclination axis 4;
- the aileron 7 is symmetrical about a symmetry axis;
- the inclination axis 4 is coincident with the symmetry axis;
- the aileron 7 is advantageously non-circular;
- the systems in a pair each equipping a different flank of the hull 2 of the vessel 1;
- the second movement is produced in an oscillatory fashion so as to move the aileron 7 alternately towards the front and towards the rear of the vessel 1;
- the first movement of the aileron is configured so as to incline the aileron in a first range of inclination values on the inclination axis during a first passage of the aileron about the pivot axis in a first rotation direction, and to incline the aileron in a second range of inclination values on the inclination axis during a second passage of the aileron about the pivot axis in a second rotation direction opposite to the first rotation direction, the first range and the second range being different;
- the first movement of the aileron has an amplitude of less than 180° inclusive about the symmetry plane;
- the first range has a value of between 0° and −90° and the second range has a value of between 0° and +90° about the symmetry plane;
- at least one from among the first and second ranges of inclination values is a single value at least over a part of one of the passages;
- the determination of the value of the second range is calculated by applying a coefficient of −1 to the value of the first range;
- the second movement has an amplitude of less than 180° about the pivot axis;
- the first movement comprises a first movement in a first direction about the inclination axis (4) when the second movement is in a first direction about the rotation axis (5), and a second movement in a second direction, opposite to the first direction about the inclination axis (4), when the second movement is in a second direction, opposite to the first direction about the rotation axis (5).

In the present description, unless stated otherwise, the following definitions of terms are used

- a vessel 1 means any craft or any vehicle able to move in a fluid, in particular water; the vessel 1 advantageously comprises a buoyancy capacity; any element sensitive to fluid movements, and particular roll, is included in this definition;
- roll: movement of the vessel 1 caused by waves not along the "prow/stern" axis of the hull 2 of a vessel 1;
- cruising speed: this is the speed at which a vessel sails outside the acceleration and deceleration phases. It is variable from one vessel to another.

The invention described below relates to a system for stabilising a vessel 1 that can be used against roll, and in particular for pleasure craft 1. This stabilisation is effective even when the vessel 1 is at rest. In a non-limitative embodiment of the invention, a vessel 1 is equipped with at least two stabilisation systems such as in FIG. 1. This stabilisation system is positioned on the hull 2 of the vessel 1.

The stabilisation system comprises an aileron 7, preferentially rectangular or not in shape, the inclination axis 4 of which may be substantially perpendicular to the hull when it is in the stabilisation function with the vessel sailing. It has in general terms a longitudinal direction along which the inclination axis 4 is directed and which is transverse to the longitudinal direction of the vessel 1, and along which the aileron 7 extends between an end close to the hull 2 and a distal end. The aileron 7 is positioned on the hull 2 of the vessel 1 below the water line of the vessel 1. The aileron 7 comprises a front edge 9, a second rear edge 8 (the term front and rear are here used relative to the front and rear of the vessel), a top surface 10 and a bottom surface 11. But it is not necessarily symmetrical. The aileron 7 is advantageously non-circular.

Rotation about this inclination axis 4 is actuated via a shaft 6 by an actuator 15 that supplies the energy necessary for the rotation of the aileron about the inclination axis 4. "Inclination" will mean the angle of this rotation that can be effected with respect to the horizontal. Advantageously, it is important to note that the aileron 7 does not make a complete rotation about its inclination axis 4. Thus the amplitude of the inclination movement of the aileron 7 about the inclination axis 4 is strictly less than 360°. The purpose of the rotation about the inclination axis 4 is solely to give the aileron an inclination with respect to the horizontal. There is not any inherent rotation of one or more turns about the axis 4. In the event of complete rotation of the aileron a Magnus effect could be created. However, the intention of the invention is absolutely not to create such an effect. Such an effect applied to the invention would even be counterproductive.

This inclination is controlled by a stabiliser computer connected to a gyrometer, these elements more globally forming part of a drive device 13 enabling the movements of the aileron 7 to be defined and executed.

The inclination axis 4 is itself able to rotate about a pivot axis 5 that is transverse (and preferably perpendicular) to it and situated in a vertical plane that contains the inclination axis 4. This pivot axis 5 is advantageously fixed in direction.

However, according to one embodiment of the invention, the rotation movement about the pivot axis 5 does not occur when the vessel is sailing at its cruising speed but only when the vessel is at rest, or optionally at very low speed.

The rotation about the pivot axis 5 is advantageously oscillatory and produces an alternating movement towards the front and towards the rear of aileron 7. In other words, the movement about the pivot axis 5 provides an angular movement of the aileron 7 alternately towards the front of the vessel and towards the rear. A cycle is therefore formed and the path of the aileron 7 has a non-zero horizontal component during this cycle. This rotation preferably occurs only for the stabilisation of the vessel at rest or at very low speed.

It is caused by the actuator 14 itself controlled by a computer, not shown, complementary to the conventional computer (the two computers may be the same assembly in a processing unit or control element that generates instruction signals for controlling the two movements of the aileron 7) and the function of which is to produce an oscillatory movement in rotation about the pivot axis 5 of the aileron when the vessel 1 is stopped. By way of example, a hydraulic jack may serve for the driving with the relay of a crankshaft system. In general, it will be possible to use any actuator 14 making it possible to provide a pivot movement in alternation (towards the front of the vessel 1, and then towards the rear, and back).

As in a conventional stabiliser, the inclination of aileron 7 is calculated according to the speed in order to create a lift, and therefore a torque on the vessel 1, opposite to and as close as possible to the one caused by the swell and making it possible to prevent roll of the vessel 1.

When the vessel 1 is at rest, the oscillation of the aileron 7, controlled by the complementary computer, compensates for the absence of the movement which, during sailing, causes the lift of the aileron 7.

Advantageously, the signal from the computer is multiplied by −1 by the complementary computer and therefore the inclination reversed, when the aileron moves towards the rear for stabilisation at rest, in order to maintain the thrust in the correct direction for countering the torque created by the swell. This example is not limitative and preferably the inclination direction and the angle of this inclination are controlled at each instant. Thus these parameters may or may not vary during an alternation of the oscillation movement or for example from one alternation to the next.

Advantageously, the first movement of the aileron 7, that is to say the movement about the inclination axis 4, has an amplitude of less than 180° inclusive and preferably between −90° and +90° about a symmetry plane. Advantageously, said symmetry plane comprises the inclination axis 4, and a straight line perpendicular both to the inclination axis 4 but also to the pivot axis 5. Advantageously, an inclination value corresponds to the value of the inclination with respect to the symmetry plane. Advantageously, the inclination value of 0° corresponds to the position in which the inclination of the aileron 7 is zero. Advantageously, a zero inclination of the aileron 7 corresponds to the inclination according to which the movement of the aileron about the pivot axis has zero influence or at least the smallest possible on the stabilisation of the vessel 1. In other words, this inclination corresponds to the situation where the pressure face and/or the suction face exerts no thrust during the movement of the aileron about the pivot axis 5.

Advantageously, a first range comprises the inclination values between 0° and +90° and a second range comprises the inclination values between 0° and −90°.

Advantageously, the inclination value during a first passage of the aileron 7 chosen from one from front to rear or from rear to front about the pivot axis 5 is to different from the inclination value during a second passage from front to rear or from rear to front of the aileron 7.

Thus, in the preferred embodiment of the invention, the inclination of the aileron 7 during its path about the pivot axis 5 may vary, without however making a complete turn about the inclination axis 4.

In another advantageous embodiment of the invention, a first inclination of the aileron 7 is preferentially calculated and then stored throughout a first path chosen from one from front to rear or from rear to front. Next, the inclination of the aileron 7 is advantageously multiplied by a coefficient of −1 in order to have an inclination opposite to the first inclination. This second inclination of the aileron 7 is preferably stored throughout a second passage chosen from the other one from front to rear or from rear to front. Next, the cycle may advantageously recommence with the calculation of a new inclination of the aileron 7. The inclination value may, in another advantageous embodiment, be fixed during one or other or both of the first and second passages or at least over part of the travel of these passages.

In all embodiments, the preferred aim of the invention is to enable the aileron 7 to have an advantageous scull movement. That is to say the performance of a helical movement of the aileron 7.

The aileron of the stabiliser may be retractable or not.

If it is not, the position of the aileron 7 when not functioning is preferably a zero inclination with respect to the horizontal.

Figure 7:
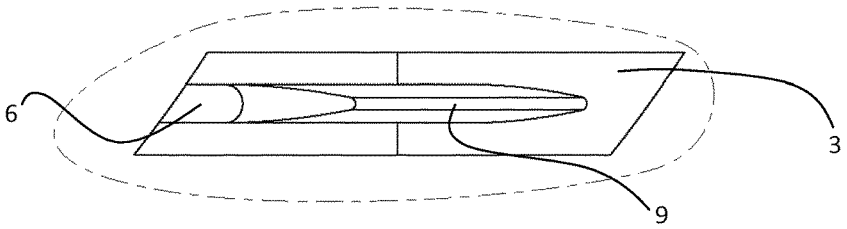
FIGS. 7 and 8 show, respectively in front and plan view, a variant of the invention with a capability of retraction of the aileron in the hull in the passive position of the stabilisation system.
Figure 8:
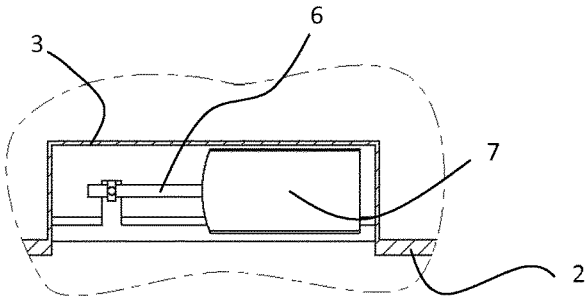

If it is retractable, its non-active position is folded along the hull 2. A chamber 3, open in the hull 2, is provided in order to receive the folded aileron 7 and this folding uses the capability of rotation about the pivot axis 5 through the passage 12. FIGS. 7 and 8 give an illustration thereof with an aileron 7 retracted in the chamber 3. FIG. 7 gives a view from the outside of the hull 2 and FIG. 8 shows a plan view.

FIGS. 3 to 6 show various possible positions of the aileron 7 during an active stabilisation phase.

In order to adapt to the various rolls that may exist, the amplitude of rotation about the inclination and pivot axes 4 and 5, and the angular velocity about said pivot and inclination axes 5 and 4, may vary. Advantageously, the movement along the pivot axis 4 for its part has an amplitude of less than 180°, and preferably lying preferentially between 0° and 170°. In addition, when the vessel 1 comprises a plurality of stabilisation systems, the processing unit may in particular coordinate the various stabilisation systems in order to optimise the stabilisation. This synchronisation may operate the stabilisation systems symmetrically and/or asymmetrically. Thus, in an embodiment of the invention comprising a plurality of stabilisation systems, one of the stabilisation systems may be in the passive position while the other or others are in the active position. In this configuration the stabilisation systems in the active position may have their own operating speed and amplitude.

The invention is not limited to the embodiments described above but extends to all embodiments in accordance with its spirit.

REFERENCES

1. Vessel
2. Hull
3. Chamber
4. Inclination axis
5. Pivot axis
6. Shaft
7. Aileron
8. Rear edge
9. Front edge
10. Top surface
11. Bottom surface
12. Passage
13. Drive device
14. First actuator
15. Second actuator

The invention claimed is:

1. A system for stabilizing a vessel, comprising an aileron able to move in a first rotation movement on an inclination axis oriented in a longitudinal direction of the aileron, and in a second movement on a pivot axis, wherein the pivot axis is transverse to the inclination axis and situated in a vertical plane containing the inclination axis, the first movement having an amplitude of strictly less than 360° and the second movement being oscillatory so as to allow a movement of the aileron in alternation towards the front and towards the rear of the vessel in order to create a scull movement.

2. The system for stabilizing a vessel according to claim 1, comprising a drive device configured so as to control the inclination of the aileron during the second movement.

3. The system for stabilizing a vessel according to claim 2, in which the drive device comprises a first rotating actuator configured so as to produce the first movement of the aileron and a second rotating actuator configured so as to produce the second movement of the aileron, and a control element configured so as to control in combination the first actuator and the second actuator.

4. The system for stabilizing a vessel according to claim 1, in which the pivot axis is perpendicular to the inclination axis.

5. The system for stabilizing a vessel according to claim 1 in which the aileron is symmetrical about a symmetry axis.

6. The system for stabilizing a vessel according to claim 5, in which the inclination axis is coincident with the symmetry axis.

7. The system according to claim 1, in which the first movement comprises a first movement in a first direction about the inclination axis when the second movement is in a first direction about the rotation axis, and a second movement in a second direction, opposite to the first direction about the inclination axis, when the second movement is in a second direction, opposite to the first direction about the rotation axis.

8. The system for stabilizing a vessel according to claim 7, in which the first movement of the aileron is configured so as to incline the aileron in a first range of inclination values on the inclination axis during a first passage of the aileron about the pivot axis in a first rotation direction, and to incline the aileron in a second range of inclination values on the inclination axis during a second passage of the aileron about the pivot axis in a second rotation direction opposite to the first rotation direction, the first range and the second range being different.

9. The system for stabilizing a vessel according to claim 8, in which the first movement of the aileron has an amplitude of less than 180° inclusive about a symmetry plane.

10. The system for stabilizing a vessel according to claim 8, in which the first range has a value of between 0° and −90° and the second range has a value of between 0° and +90° about the symmetry plane.

11. The system for stabilizing a vessel according to claim 8, in which at least one from among the first and second ranges of inclination values is a single value at least over part of one of the paths.

12. The system for stabilizing a vessel according to claim 8, in which the value of the second range is the opposite of the value of the first range.

13. The system for stabilizing a vessel according to claim 1, in which the second movement has an amplitude of less that 180° about the pivot axis.

14. The system for stabilizing a vessel according to claim 1, in which the aileron has a non-circular shape.

15. A vessel equipped with at least one system according to claim 1.

16. The vessel according to claim 15, comprising at least one pair of systems according to claim 15, the systems in a pair each equipping a different flank of the hull of the vessel.

17. A method for stabilizing a vessel, comprising a driving of an aileron in a first rotation movement on an inclination axis extending in a longitudinal dimension of the aileron, and in a second movement on a pivot axis, wherein the pivot axis is placed transversely to the inclination axis and situated in a vertical plane containing the inclination axis, the first movement has an amplitude of strictly less than 360°, and in which the second movement is produced in an oscillatory fashion so as to move the aileron alternately towards the front and towards the rear of the vessel in order to create a scull movement.

* * * * *